US005121911A

United States Patent [19]

Yamazaki et al.

[11] Patent Number: 5,121,911

[45] Date of Patent: Jun. 16, 1992

[54] FINISHER FOR AN IMAGE FORMING APPARATUS

[75] Inventors: Hideo Yamazaki, Tokyo; Kazunori Kubota, Yokohama; Yuichi Fujii, Nagoya, all of Japan

[73] Assignee: Ricoh Company, Ltd., Tokyo, Japan

[21] Appl. No.: 627,191

[22] Filed: Dec. 13, 1990

[30] Foreign Application Priority Data

Dec. 13, 1989 [JP] Japan ..... 1-143809[U]

[51] Int. Cl.[5] ..... B42B 2/00

[52] U.S. Cl. ..... 270/53; 271/213; 270/52

[58] Field of Search ..... 270/52, 53, 58; 271/207, 213, 220

[56] References Cited

U.S. PATENT DOCUMENTS 4,735,408 4/1988 Yamashita ..... 270/58
4,883,265 11/1989 Iida ..... 271/220
4,973,036 11/1990 Yamashita ..... 270/53
4,988,087 1/1991 Sardano ..... 271/220

FOREIGN PATENT DOCUMENTS 51272 3/1988 Japan ..... 270/58
147767 6/1988 Japan ..... 271/213
147771 6/1988 Japan ..... 271/220

*Primary Examiner*—Edward K. Look
*Assistant Examiner*—Therese M. Newholm
*Attorney, Agent, or Firm*—Oblon, Spivak, McClelland, Maier & Neustadt

[57] ABSTRACT

A finisher for use with a copier, printer or similar image forming apparatus for sorting or otherwise finishing recording sheets sequentially driven out of the apparatus. A positioning member in the form of a fur brush urges paper sheets sequentially delivered from the apparatus to a tray of the finisher to a predetermined position. At this instant, the paper positioning member does not interfere with a shifting motion of the tray.

8 Claims, 12 Drawing Sheets

| Fig.16A | Fig.16B |
|---|---|

FINISHER FOR AN IMAGE FORMING APPARATUS

BACKGROUND OF THE INVENTION

The present invention relates to a finisher for use with a copier, printer or similar image forming apparatus and operable to sort recording sheets, or paper sheets, sequentially driven out of the apparatus by shiting them or otherwise finish such paper sheets.

Finishers for use with an image forming apparatus include one which delivers paper sheets sequentially driven out of the apparatus to shiftable tray and shifts and thereby sorts them volume by volume on the tray. In this type of finisher, the tray for collecting the paper sheets is shifted by sorting means in a horizontal plane in a direction perpendicular to an intended direction of paper discharge. Each paper sheet discharged onto the tray is positioned in a direction perpendicular to an intended direction tray shift by the positioning member, i.e., at the trailing edge thereof and then shifted.

The problem with the conventional finisher described above is that he positioning member remains in contact with the top of the paper stack loaded on the tray and, therefore, interferes with the shift of the tray. Specifically, the positioning member dislocates the paper sheets neatly stacked on the tray when the tray is caused into a shifting motion. It is likely that the paper stack is dislocated not only in the intended direction of tray shift but also in the direction perpendicular thereto. To eliminate this problem, the discharge tray may be shifted while being moved in the up-and-down direction, as proposed in the past. However, such a movement of the tray is not reliable and not practicable without resorting to a complicated mechanism.

SUMMARY OF THE INVENTION

It is therefore an object of the present invention to provide a finisher for an image forming apparatus which sorts paper sheets in a desirable manner while positioning the individual paper sheets accurately and, yet, has a simple construction.

A finisher for finishing recording sheets sequentially driven out of an image forming appartus of the present invention has a tray for collecting the paper sheets sequentially driven out of the apparatus, and a sorting mechanism for causing the tray to move in a horizontal plane in a direction perpendicular to an intended direction of paper discharge and thereby sorting the paper sheets. The sorting mechanism has a positioning member for urging the paper sheet discharged onto the tray to a predetermined position, and a stop member adjoining the predetermined position. The positioning member comprises fur brushes (i.e., brushes coated with a fur like material or bristled material) each being rotatable in contact with the upper surface of the paper sheet and in contact with the stop plate.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
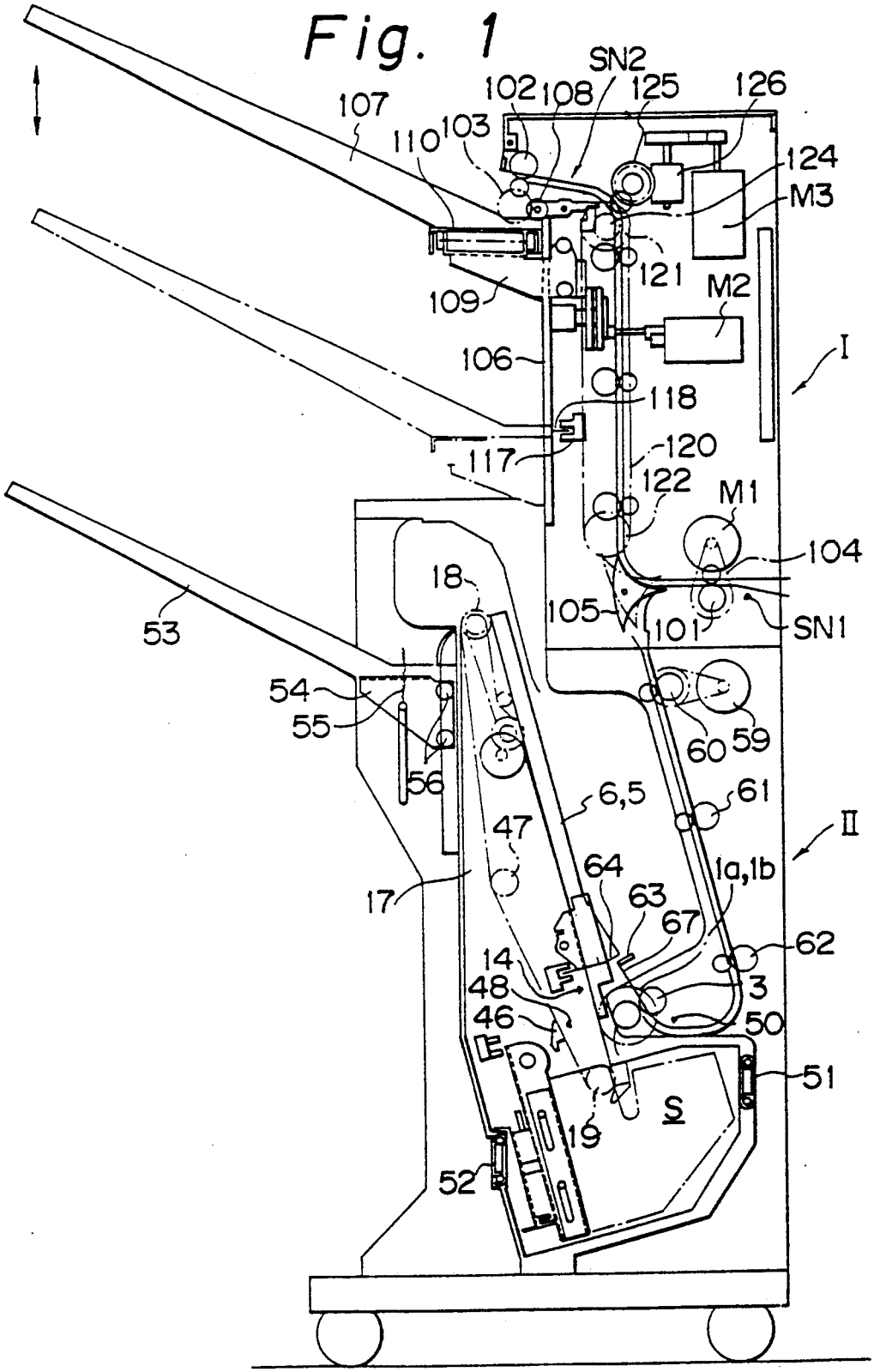
FIG. 1 is a side elevation showing the overall construction of a finisher embodying the present invention.

Referring to FIG. 1 of the drawings, a finisher embodying the present invention is shown which is operatively connected to one side of an image forming apparatus, not shown. As shown, the finisher is generally made up of a shiftable sorting section I and a stapling section II which is disposed below the sorting section 1.

The shitable sorting section I has a paper transport path along which a plurality of transport rollers and driven rollers associated therewith are arranged. Specifically, a first transport roller 101 is mounted on a shaft which is in driven connection with the output shaft of a transport drive motor M1 through a first timing belt 104. The shaft of the roller 101 is in turn drivably connected by a second timing belt, not shown, to the shafts of the other transport rollers, the shaft of a discharge roller 102, and the shaft of a fur brush 103 which is adapted to position a paper sheet.

Paper sensors SN1 and SN2 immediately precedes the transport roller 101 and the discharge roller 102, respectively. The paper sensors SN1 and SN2 each is responsive to the leading and trailing edges of a paper sheet being transported. A guide pawl 105 is positioned downstream of the transport roller 101 and operated by a solenoid 230 (FIG. 9) and a spring, not shown, to select either one of a transport path extending to the stapling section II and a transport path extending to the sorting section I.

Figure 2:
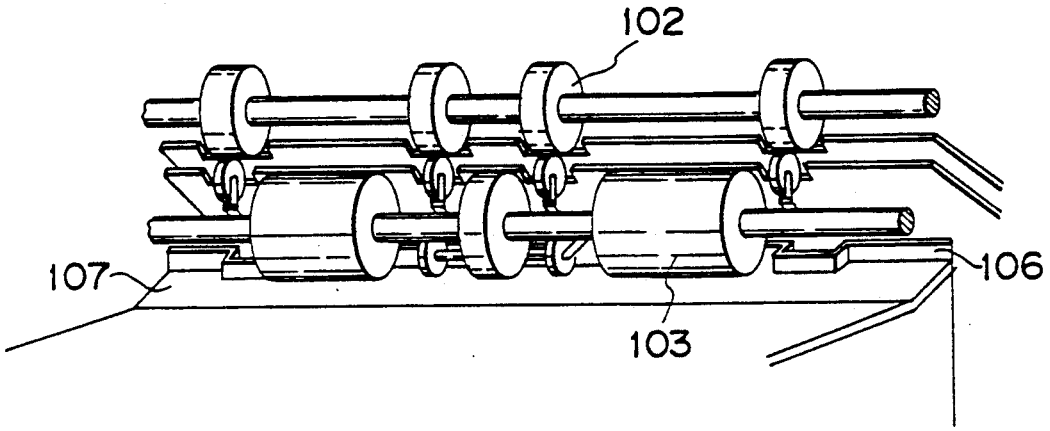
FIG. 2 is a perspective view of a paper discharging section associated with an upper tray.
Figure 3:
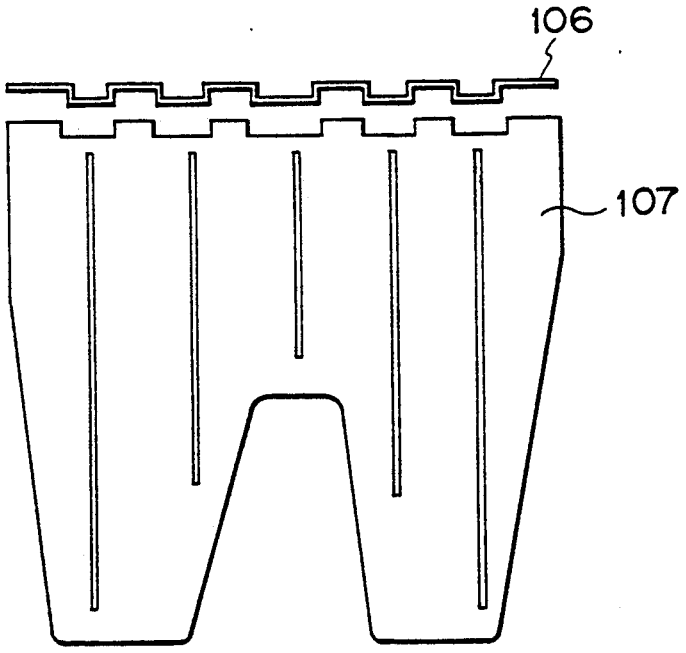
FIG. 3 is a plan view showing the upper tray and a stop plate which is engaged with the upper tray and included in a tray shifting mechanism.
Figure 4:
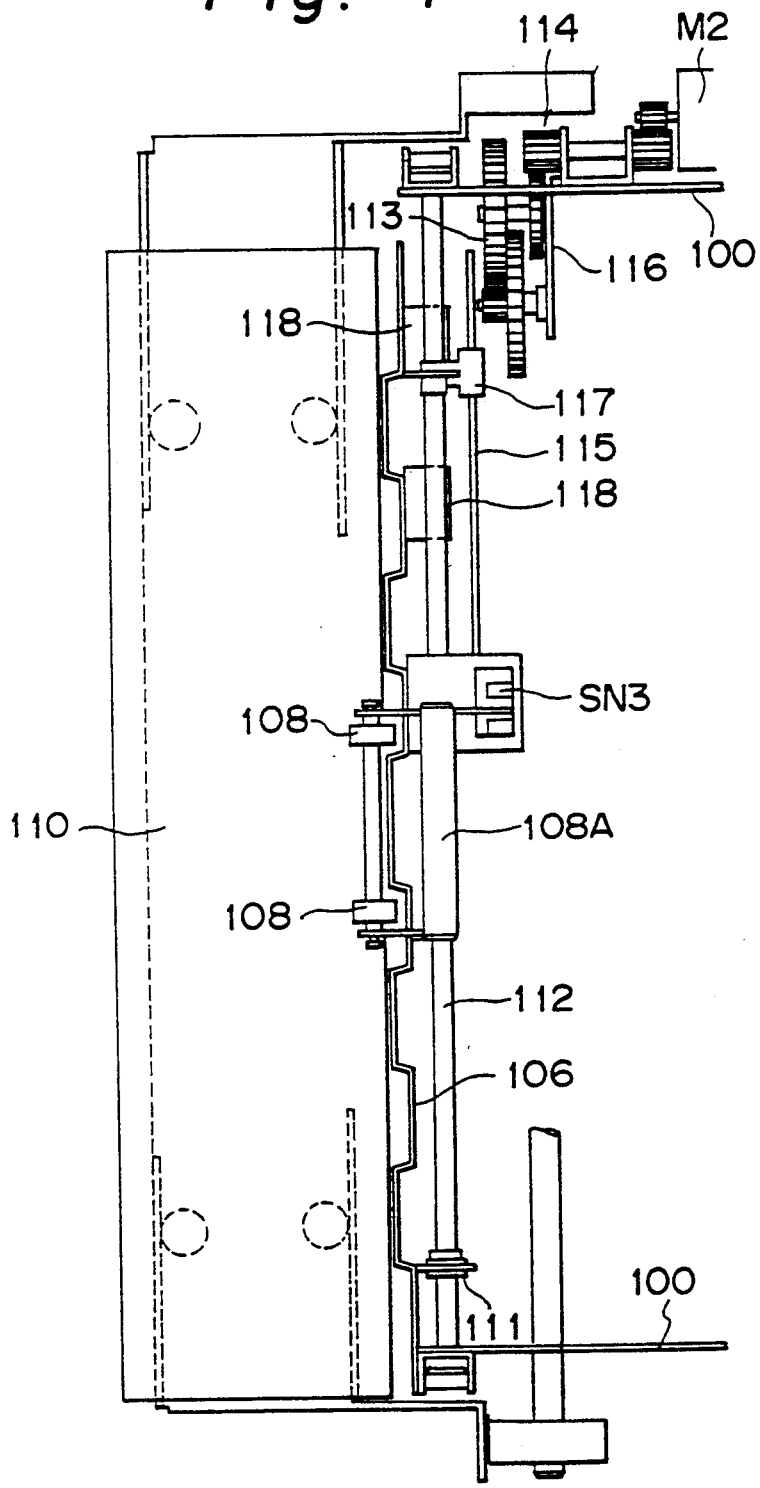
FIGS. 4 and 5 are respectively a plan view and a perspective view each showing a drive line included in the tray shifting mechanism.

As shown in FIGS. 2, 3 and 4, a fur brush 103 is disposed immediately below the discharge roller 102 and in the vicinity of the paper outlet. The fur brush 103 serves as a member for urging a paper sheet discharged onto the tray 107 to a predetermined position. A stop plate 106 also located below the discharge roller 102 and in the position to which a paper sheet will be moved by the fur brush 103. The fur brush 103 is constantly rotated during a sequence of operations while contacting the upper surfaces of the successive paper sheets. As a result, a paper sheet dropped onto the discharge tray 107 is thrusted by friction toward the stop plate 106 by the rotating fur brush 103 and, on abutting against the stop plate 106, it has the trailing edge thereof positioned. When the discharge tray 107 is caused into a shifting motion which will be described, the fur brush 103 which is constantly rotated exerts a smaller resistance to the shifting motion than when out of rotation. More specifically, the resistance exerted by the fur brush 103 in rotation on the uppermost paper sheet of the stack loaded on the tray 107 is smaller than the resistance which the fur brush 103 would exert when out of rotation. Further, the paper stack on the tray 107 is held in abutment against the stop plate 106 even during the shifting operation, so that the paper stack is surely maintained in the regulated position on the tray 107.

The fur brush 103 is also held in contact with the stop plate 106 while in rotation. An arrangement is made such that the friction exerted in the thrusting direction by the fur brush 103 on the paper sheet is smaller than the friction acting between the fur brush 103 and the stop plate 106. This occurs by compression of the fur like material covering brush 103. This further promotes accurate positioning of the paper sheets.

Figure 5:
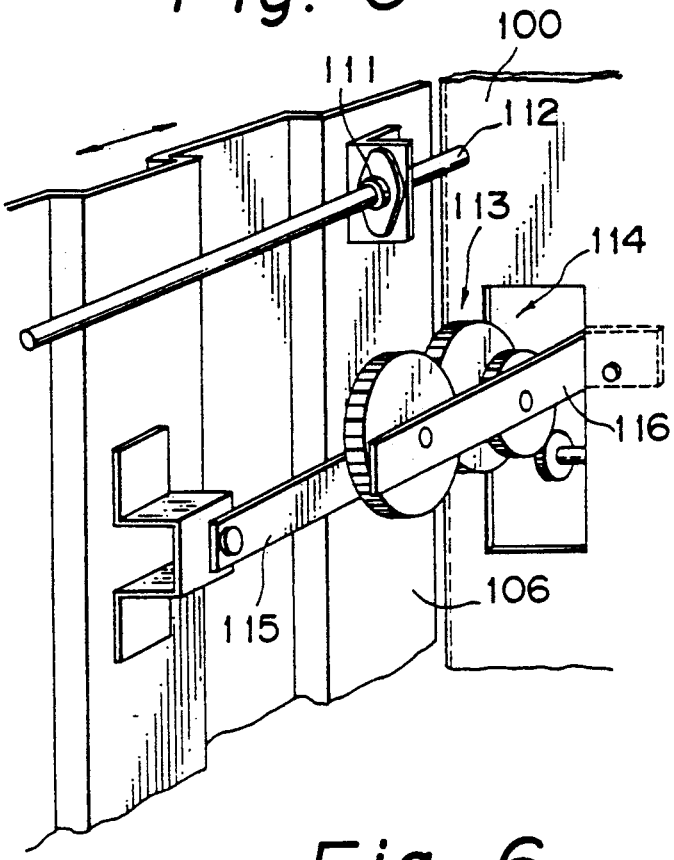

As FIG. 3 indicates, the stop plate 106 and upper tray 107 are provided with projections and recesses which mate with each other. In this configuration, the tray 107 is freely movable up and down (direction perpendicular to the sheet surface of FIG. 3) relative to the stop plate 106 and movable backward and forward (left-and-right direction in FIG. 3) interlocked with the stop plate 106. As shown in FIGS. 4 and 5, the stop plate 106 is mounted on a rod or shift guide 112 through a bearing 111 at the side adjacent to the image forming apparatus and, therefore, free to move backward and forward. As also shown in FIG. 5, the stop plate 106 is connected to a crank 113 by an arm rod 115 in an eccentric position. The crank 13 has an axis of rotation which extends parallel to the center axis of the image forming apparatus, e.g. a copier. A bracket 116 is removably mounted on a side wall 100 and extends perpendicularly from the latter. A gear train 114 is mounted on the bracket 116 to operatively connect the crank 113 to a shift motor M2. The shift motor M2 drives the crank 113 so that the stop plate 106 is caused into a reciprocating motion due to the eccentric rotation of the crank 113. Then, the stop plate 106 moves the discharge tray 107 backward and forward, as stated earlier. A shift sensing plates 118 protrude from the stop plate 106 and are spaced apart from each other by a distance which is substantially the same as the displacement defined by the crank 113. A shift sensor 117 is located to face the stop plate 106 so as to detect the end of an iterative operation consisting of the abutment of a paper sheet and the shift of the tray 107.

Figure 6:
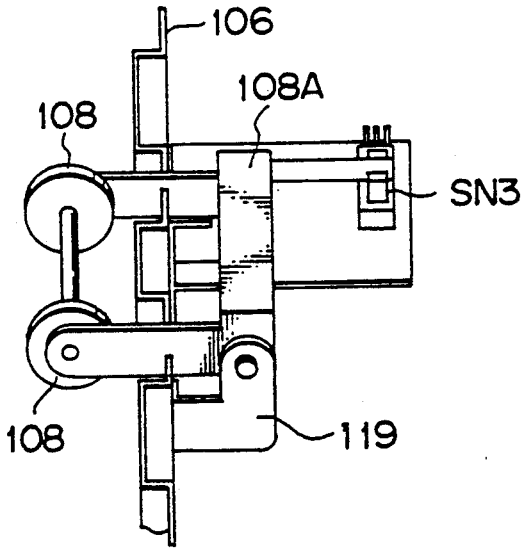
FIG. 6 is a perspective view of a paper pressing mechanism.

As also shown in FIG. 6, a bracket 119 is rigidly mounted on the stop plate 106. Presser rollers 108 are supported by the bracket 119 in such a manner as to be rotatable and movable up and down, thereby constantly pressing itself against the top of a paper stack by gravity. Specifically, a paper sheet is caused to get under the presser rollers 108 by gravity and the force of the fur brush 103 into it abuts against the stop plate 106. When the upper tray 107 is shifted as stated earlier, the presser rollers 108 and fur brush 103 serve to prevent paper sheet from being dislocated. A paper surface sensor SN3 is mounted on the finisher body to face the presser rollers. When the presser rollers 108 are raised by paper sheets which are sequentially tacked on the tray 107, the paper surface sensor SN3 senses a part of a roller support bracket 108A and thereby determines that the top of the paper stack or the upper surface of the discharge tray 107 has reached a predetermined height.

Figure 7:
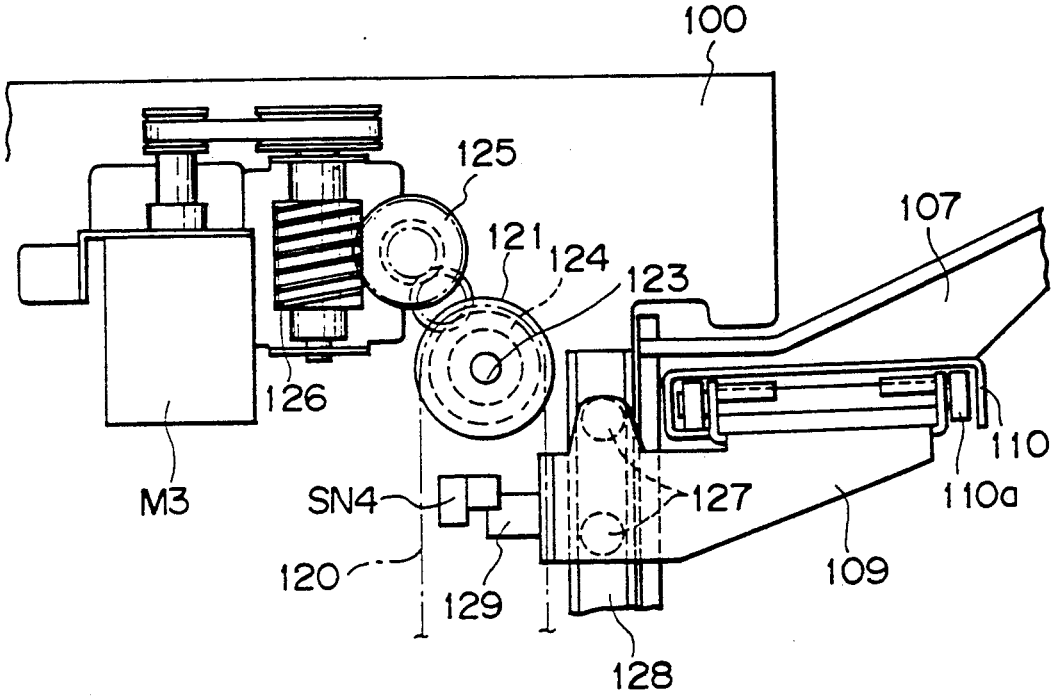
FIGS. 7 and 8 are respectively a side elevation and a perspective view of a mechanism for moving the upper tray up and down.
Figure 8:
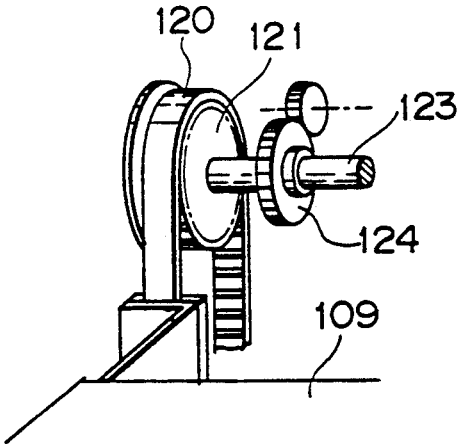

Referring to FIGS. 7 and 8, an elevating mechanism includes a tray support 110 on which the upper tray 107 is rigidly mounted. The tray support 110 is in turn loaded on a tray mounted 109 through bearings 110*a* in such a manner as to be movable back and forth thereon. This allows the tray 107 to be shifted in the previously described manner by the stop plate 106 on the tray mount 109. The tray mount 109 is affixed to a third timing belt 120, as also shown in FIG. 1. The third timing belt 120 is located at the outside of each of the front and rear side panels 100. Each timing belt 120 is passed over a drive pulley 121 and a driven pulley 122. The two drive pulleys 121 are securely mounted on a drive shaft 123 which extends throughout the opposite side panels 100. A gear 124 is mounted on the drive shaft 123 and has a one-way clutch thereinside. The one-way clutch is so constructed as to transmit a force acting in a direction for elevating the discharge tray 107 to the drive shaft 123. The gear 124 is connected to an elevation motor M3 by a gear train, a worm wheel 125, and a worm 126. Bearings 127 are mounted on the sides of the tray mount 109 which face the side panels 100, while guide rails 128 are mounted on the side panels 100. The bearings 127 and guide rails 128 are mated together to guide the up-and-down movement of the tray mount 109 while preventing the tray 107 from falling due to the moment of rotation ascribable to gravity.

In the above-described mechanism, the upper tray 107 is usually prevented from moving downward due to the retaining force of the worm 126 and the locked state of the one-way clutch. When the elevation motor M3 is driven in a direction for elevating the tray 107, the one-way clutch is locked to rotate the pulleys 121 and 122 with the result that the tray 107 is elevated. When the motor M3 is rotated in the other direction, i.e., in a direction for lowering the tray 107, the one-way clutch is unlocked to allow the tray 107 to move downward due to gravity.

Figure 9:
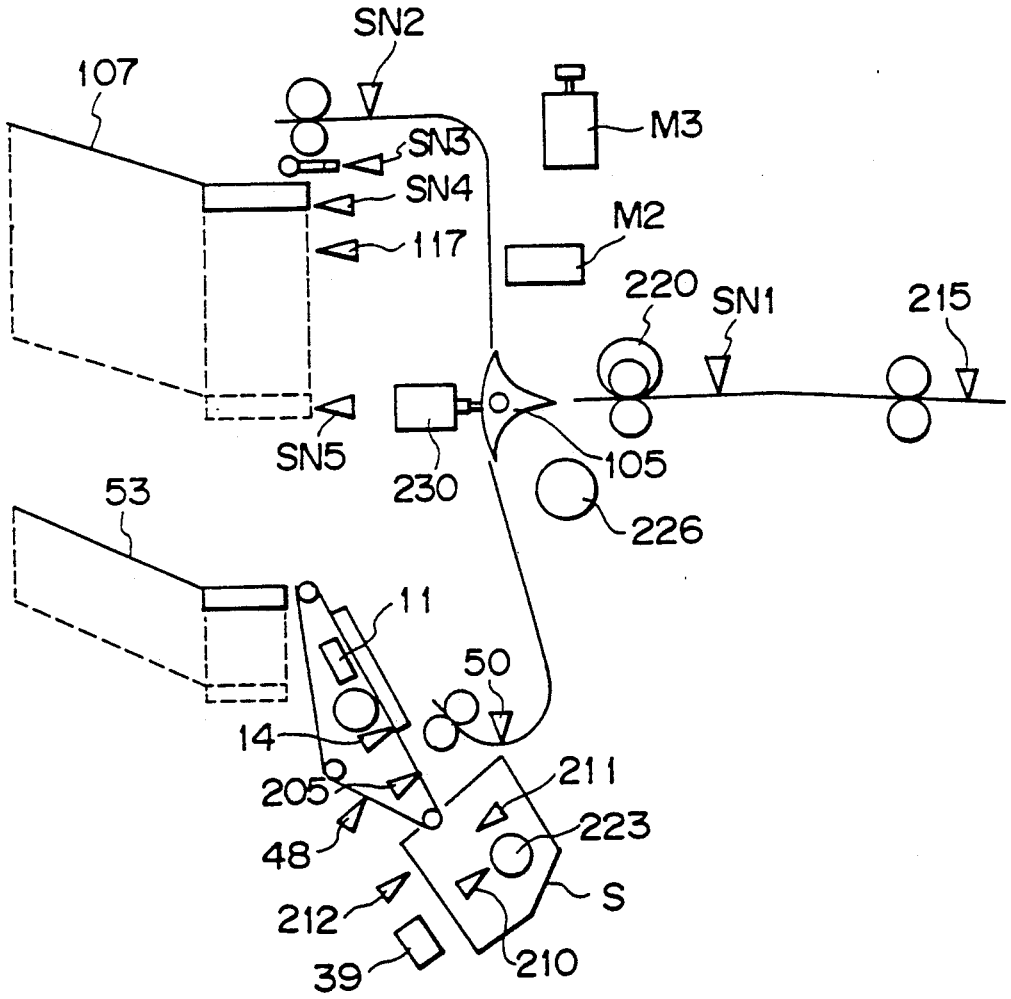
FIG. 9 is a schematic side elevation representative of a paper discharging arrangement.

As also shown in FIG. 9, an upper limit sensor SN4 and a lower limit sensor SN5 are disposed inward of the timing belts 120 and to face the tray 107. The sensors SN4 and SN5 sense respectively the upper limit position and the lower limit position of the tray 107 in cooperation with an elevation sensing plate 129. While the tray 107 is in a downward movement, the one-way clutch is unlocked and, therefore, the rotation of the elevation motor M3 is not transmitted to the tray 107. Hence, even when the tray 107 is held in a halt by an externally derived force during the downward movement, the motor M3 simply idles and is, therefore, free from overloads while preventing, for example, the operator's fingers from being caught.

When a copying operation begins, the shift motor M2 is driven to rotate the crank 113. In turn, the crank 113 moves the stop plate 106 in the back-and-forth direction via the rod 115. The stop plate 106 in turn begins to shift the tray 107 in the same direction. As soon as the shift sensor 117 senses one of the shift sensing plates 118 which is different from the other which it has sensed before the start of the shifting operation or when the upper limit sensor SN4 senses the elevation sensing plate 129, the shift motor M2 is deenergized to end the shifting operation. When the paper surface sensor SN3 senses the bracket 120, the elevation motor M3 is driven in the direction for lowering the tray 107. The elevation motor M3 is deenergized when the sensor SN3 stops sensing the bracket 120. More specifically, the elevation motor M3 is driven in the direction for elevating the discharge tray 107. As the paper surface sensor SN3 senses a part of the bracket 108A which supports the presser rollers 108 or as the upper limit sensor SN4 senses the elevation sensing plate 129, the elevation motor M3 is deenergized to stop the elevation of the tray 107. When the paper surface sensor SN3 senses the bracket 120, the motor M3 is driven in the direction for lowering the tray 107. This rotation of the motor M3 is stopped when the sensor SN3 stops sensing the bracket 120.

The feed roller 101 receives a paper sheet having been driven out of the copier at the same linear speed as the discharge speed of the copier. As the first paper sensor or inlet sensor SN1 senses the trailing edge of the paper sheet, the linear speed is switched to a higher speed which is higher than the discharge speed of the copier. On the lapse of a predetermined period of time after the inlet sensor SN1 has sensed the trailing edge of the paper sheet, the linear speed is switched over to the original or lower speed. Then, the paper sheet is driven out onto the tray 107. The paper sheet gets under the presser rollers 108 due to gravity and the force of the rotating fur brush 103 until it abuts against the stop plate 106, whereby the trailing edge of the paper sheet is regulated in position.

When more than a predetermined number of paper sheets, or copies, are stacked on the tray 107, the shift motor M2 is driven to start shifting the tray 107. On completing a single shifting operation, the shift motor M2 is deenergized. As a result, the position of the paper stack on the tray 107 is changed and thereby sorted on the tray 107. When a copy produced by the last one of a sequence of copying cycles is discharged onto the tray 107, the elevation motor M3 is rotated in the direction for lowering the tray 107. The tray 107 is brought to a stop when moved downward over a predetermined distance.

More specifically, assume that a predetermined number of paper sheets have been stacked on the upper tray 107 with the top of the stack being positioned near the paper outlet. Then, the paper sensor SN3 senses a part of the bracket 108A to drive the elevation motor M3 in the direction for lowering the tray 107. This cancels the retaining force of the worm 126 and unlocks the one-way clutch, causing the tray 107 to move downward by gravity. As the top of the paper stack on the tray 107 is lowered to such a level that the paper sensor SN3 does not sense the bracket 108A any longer, the elevation motor M3 is deenergized. Then, the one-way clutch is locked to stop the movement of the tray 107 in cooperation with the worm 126. When the tray 107 is lowered until the lower limit sensor SN5 senses the elevation sensing plate 129, the motor M3 is deenergized to prevent the tray 107 from being lowered any further.

Referring to FIGS. 1, 10, 11 and 12, a mechanism for moving a stapler S included in the stapling section II will be described. The stapler S is rigidly mounted on a stapler mount 31. A guide pin 32 extends out from the stapler mount 31 and is received in a guide slot 30*b* which is formed through a stapler slider 30. In this configuration, the stapler mount 31 is movable in a direction indicated by an arrow l in FIG. 2. A shaft 44 is mounted on the back of the stapler mount 31, while a guide roller 34 is rotatably mounted on the shaft 44. A guide rod 36 is supported at opposite ends thereof by side plates 41 and 42. The stapler slider 30 is mounted at an upper portion thereof on the guide rod 36 and slidable along the latter in a direction perpendicular to the sheet surface of FIG. 12. A guide roller 33 is provided on a lower portion of the stapler slider 30 and rolls on the surface of a stay 43 which is mounted on the finisher body, thereby restricting the stapler slider 30 with respect to the angular movement. A guide cam 35 is affixed to the stay 43 and provided with a cam surface at the upper end thereof. The guide roller 34 rollably rests on the cam surface of the guide cam 35. In this configuration, the stapler slider 30 is movable in a reciprocating motion as indicated by an arrow k in FIG. 10. The intermediate portion of the guide cam 35 is recessed downward so as to cam the stapler slider 30.

Figure 10:
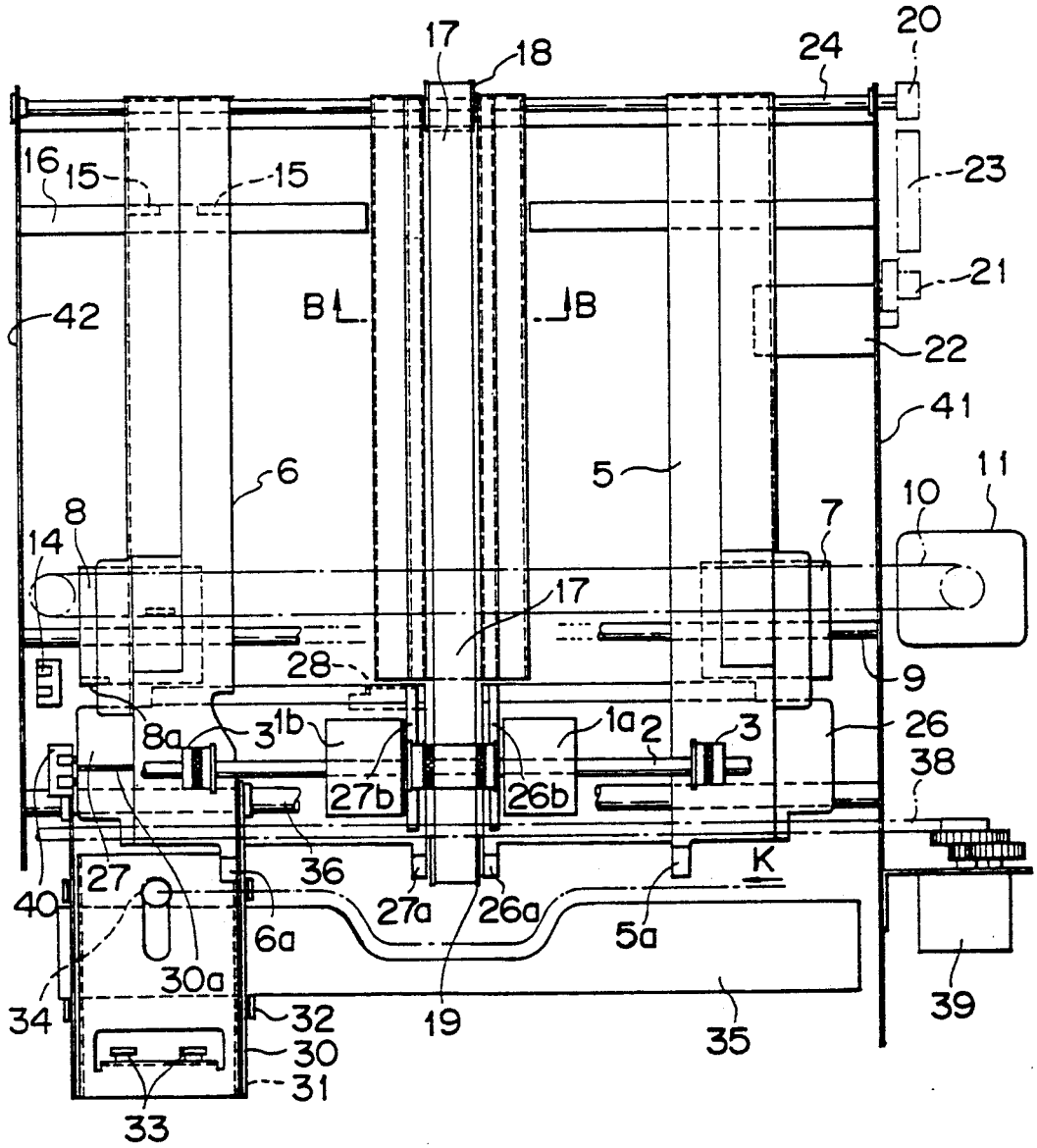
FIGS. 10 and 11 are respectively a front view and a bottom view of a stapling section.
Figure 11:
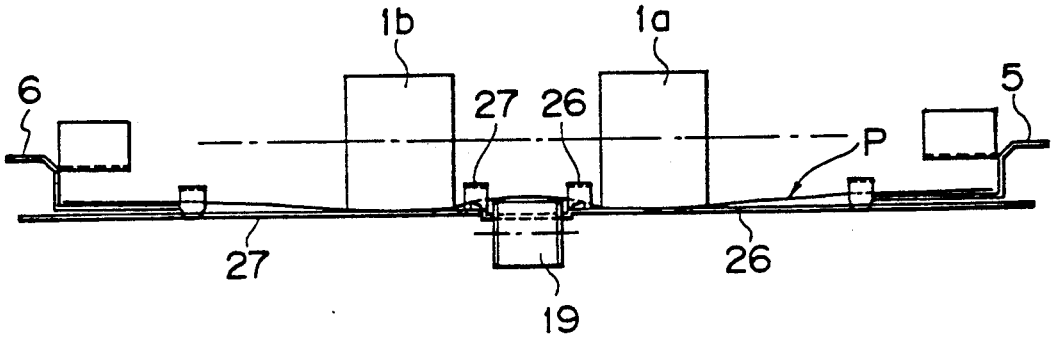
Figure 12:
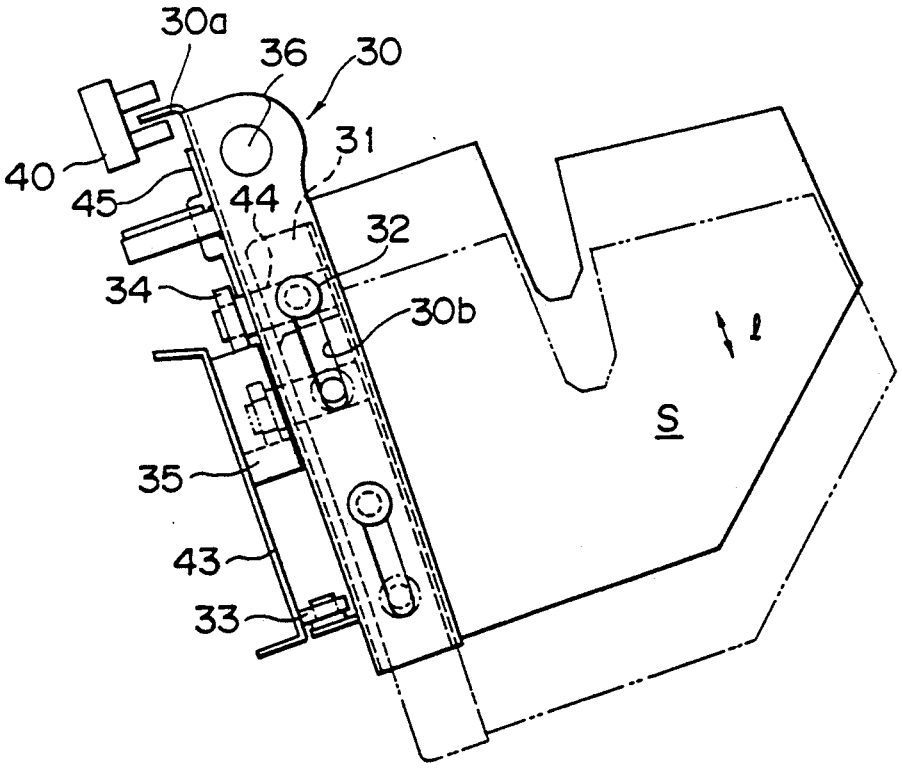
FIG. 12 is a side elevation representative of a structure for mounting a stapler.

A sensing plate 30*a* is mounted on the upper end of the stapler slider 30, while a home position sensor 40 having a sensing section is mounted on the finisher body. When the sensing plate 30*a* blocks the sensing section of the home sensor 40, the home position (HP) of the stapler S is sensed. A stepping motor 39 for moving the stapler S is mounted on the side wall 41, as shown in FIG. 10. The motor 39 drives a belt 38 to which the stapler slider 30 is affixed. Hence, the belt 38 drives the stapler slider 30 in the right-and-left direction of FIG. 10 by way of the belt 38.

Figure 13:
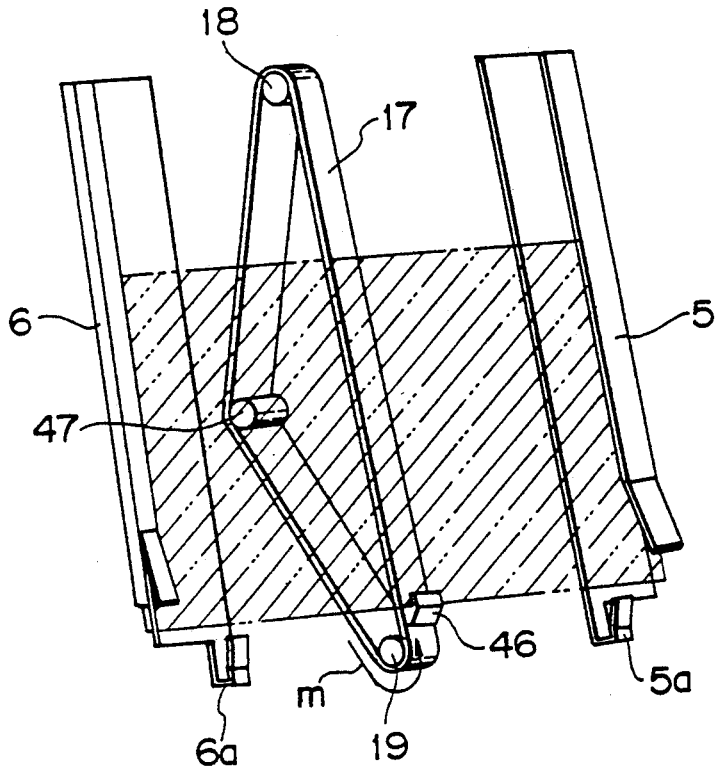
FIG. 13 is a perspective view of a discharging device associated with a lower tray.

A mechanism for moving jogger fences will be described with reference to FIGS. 10 and 13. As shown, the mechanism includes a jogger fence rod 9 extending between the opposite side walls 41 and 42. A right slider 7 and a left slider 8 are mounted on the jogger fence rod 9 to be movable in a reciprocating motion therealong. A right jogger fence 5 and a left jogger fence 6 are rigidly mounted on the right and left sliders 7 and 8, respectively. The jogger fences 5 and 6 function to neatly arrange a stack of paper sheets in the event of a stapling operation. Also, the jogger fences 5 and 6 extend from the vicinity of discharge rollers 3 to the vicinity of a lower tray or discharge tray 53 so as to play the role of guide members for guiding a stapled paper stack. The jogger fences 5 and 6 are respectively provided with rear end fences 5*a* and 6*a* for sustaining the lower end of a stapled paper stack.

Figure 15:
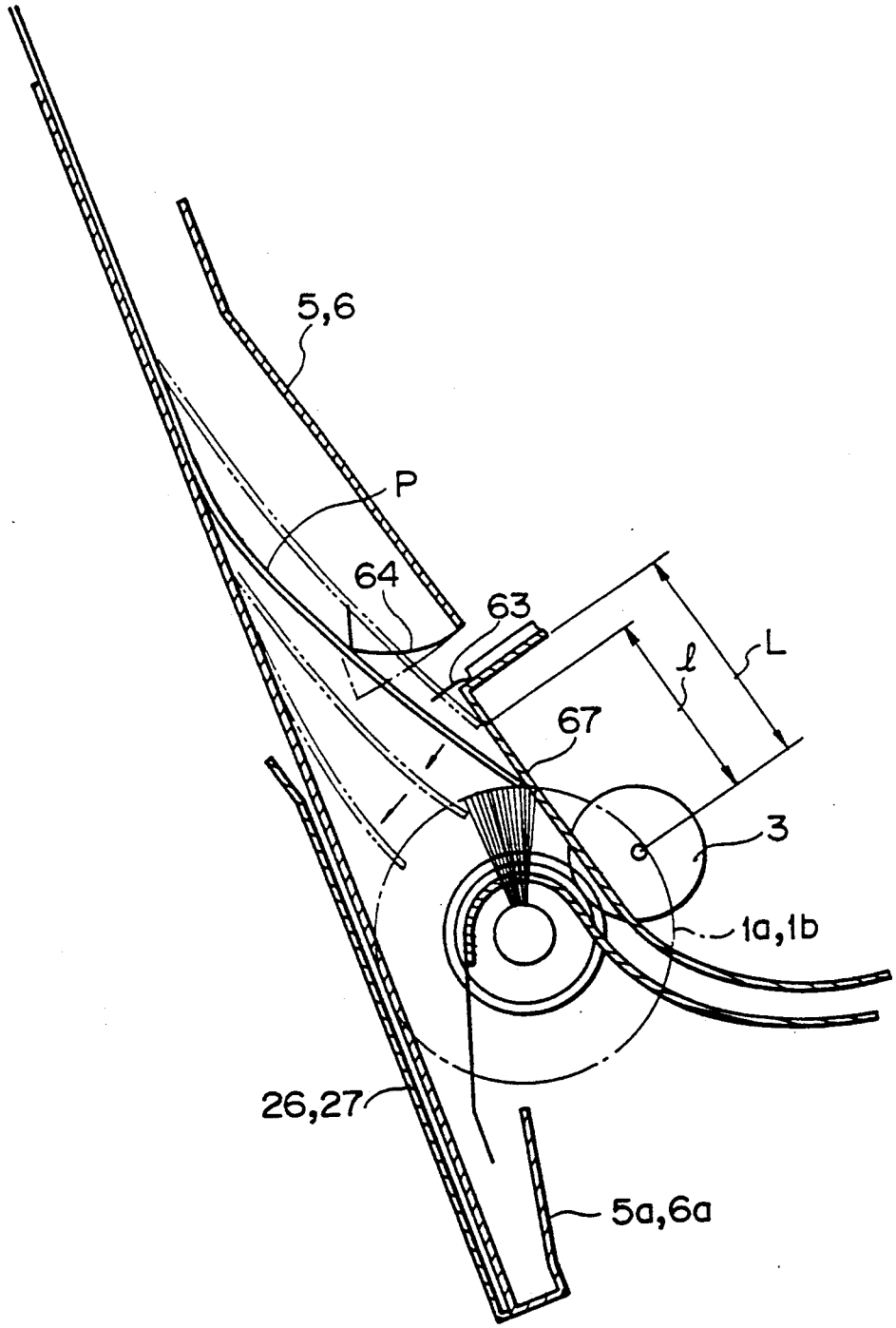
FIG. 15 is an elarged side elevation of a stapling and discharging section associated with the lower tray.

The right and left sliders 7 and 8 are affixed to a belt 10 which is driven by a jogger fence motor 11. More specifically, each of the sliders 7 and 8 is affixed to a different run of the belt 10 so that their associated jogger fences 5 and 6 may move in a reciprocating motion toward and away from each other in the right-and-left direction as viewed in FIG. 10. Guide rollers 15 are provided on the back of an upper portion of each of the jogger fences 5 and 6. The guide rollers 15 roll on a guide stay 16 which extends between and in an upper portion of the side walls 41 and 42. A sensing plate 8*a* is mounted on the left slider 8. The home position (HP) of jogger fences 6 and 5 is sensed when the sensing plate 8*a* blocks a sensing section of a home position sensor which is mounted on the finisher body. As also shown in FIG. 15, a pressing member 64 is provided at the lower end of each of the jogger fences 5 and 6 for preventing a paper sheet P from curling on the staple tray. The pressing member 64 may be implemented by a resilient member in the form of a polyester film, for example.

Figure 14:
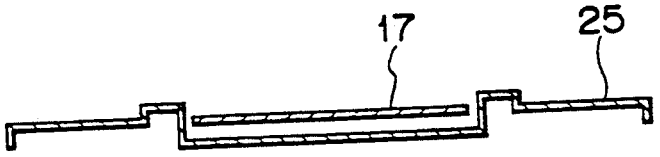
FIG. 14 is a section along line B–B of FIG. 13.

A discharge belt mechanism will be described with reference to FIGS. 10, 13 and 14. A drive shaft 24 is journalled to upper portions of the opposite side walls 41 and 42. A drive pulley 18 is mounted on the drive shaft 24 at substantially the intermediate between opposite ends of the latter. A pulley 19 is located below the drive pulley 18. An endless discharge belt 17 is passed over the pulleys 18 and 19 as well as over an idle pulley 47. A guide plate 25 is located inward of the belt 17 to free the latter from slackening and dislocation. A belt motor 22 is mounted on the side wall 41, while a pulley 21 is mounted on the output shaft of the motor 41. A belt 23 is passed over the pulley 21 and a pulley 20 which is mounted on one end of the drive shaft 24. A pawl 46 (FIGS. 1 and 13) protrudes from the surface of the belt 17 in order to sustain a paper stack, as will be described. As shown in FIG. 4, a home position sensor 48 is positioned between the opposite runs of the belt 17 for sensing the home position (HP) of the pawl 46. The belt 17 is movable at a speed $V_2$ which is equal to or slightly higher than the linear speed $V_1$ of the discharge rollers 3, so that a paper stack to be stapled next may be prevented from being discharged together with a stapled paper stack.

The various mechanisms of the stapler S described above are constructed into a single unit. Such a unit can be pulled out toward the operator along guide rails 51 and 52.

As shown in FIG. 1, a mechanism associated with the lower tray 53 includes a tray mount 54 on which the tray 53 is rigidly mounted. Guide rollers 56 are rotatably mounted on the tray mount 54 and engaged with a guide rail, not shown. The tray 53 is, therefore, movable up and down together with the tray mount 54. A lift spring 55 constantly biases the tray mount 54 upward.

A transport motor 59 is drivably connected to transport rollers 60, 61 and 62 by a belt, not shown. The transport motor 59 is also drivably connected to the discharge rollers 3 by a belt, not shown. Fur brushes 1*a* and 1*b* are mounted on the shaft 2 together with the discharge rollers 3 and are rotatable in synchronism with the rollers 3. The tips of the fur brushes 1*a* and 1*b* are held in contact with guide plates 26 and 27, respectively. The guide plates 26 and 27 have respectively ribs 26*b* and 27*b* for holding the lower end of a stapled paper stack. The guide plates 26 and 27 further have respectively ribs or projections 26*b* and 27*b* on their front faces. The ribs 26*b* and 27*b* and the fur brushes 1*a* and 1*b* cooperate to bend press a paper stack from opposite sides to thereby deform it backward in a wave-like configuration, whereby the paper stack is provided with a certain degree of rigidity.

As shown in FIG. 15, an outlet upper guide plate 67 protrudes beyond the center of rotation of the discharge rollers 3 by an amount L which is greater than an amount l over which an incoming paper sheet P protrudes. Therefore, even when the paper sheet S fails to drop below the fur brushes 1*a* and 1*b* and enters the gap between the upper guide plate 67 and the fur brushes 1*a* and 1*b*, the tips of the fur brushes 1*a* and 1*b* will successfully urge the trailing edge of the paper sheet P downward.

How the finisher handles incoming paper sheets will be described. Assume that the operator selects a staple mode by a staple key, loads a document table (RDH) with N documents, and operates numeral keys to enter a desired number K of volumes of copies. Thereafter, as the operator presses a copy start key, the copier body sends a copy size signal to the finisher. In response, the finisher determines whether or not the stapling section can accommodate paper sheets of the expected size. If the answer of the decision is positive, whether or not the pawl 46 of the discharge belt 17 is located at the home position is determined. If the pawl 46 is not in the home position, the belt motor 22 is driven to return it to the home position. Whether or not the stapler S is in the home position is determined and, if it is in the home position, the stapler S is moved by the size signal to the predetermined position. If it is not in the home position, the stapler S is moved until the home position has been sensed and then moved to the predetermined position by the size signal.

Whether or not the jogger fences 5 and 6 are held in their home position is determined and, if the answer is positive, they are moved to predetermined positions by the size signal. If otherwise, the jogger fences 5 and 6 are moved intil the home position has been sensed and then moved to the predetermined positions by the size signal. Specifically, the jogger fences 5 and 6 will each be moved to a position which is a millimeters short of the size width, i.e. 2a millimeters at opposite sides of the size width.

When the inlet sensor SN1 senses the trailing edge of a paper sheet, the guide pawl 105 is switched over by the solenoid 230 to steer the paper sheet toward the staple tray. As soon as the leading edge of the paper sheet moves away from the inlet sensor SN1, the transport speed is switched to the higher speed. The solenoid 230 is deenergized on the lapse of a predetermined period of time after the leading edge of the paper sheet has moved away from the inlet sensor SN1, i.e., when it moves away from the guide pawl 105. The discharge rollers 3 drive the paper sheet onto the staple tray. At this instant, an exclusive brush 63 mounted on the upper guide plate 67 dissipates a charge from the paper sheet. The discharge rollers 3 have flange to deform the paper sheet in a wave-like configuration and thereby provides the latter with a certain degree of rigidity. When the trailing edge of the paper sheet moves away from the rollers 3, the fur brushes 1*a* and 1*b* coaxial with the rollers 3 urge it upward. Consequently, the trailing edge of the paper sheet is caused into abutment against the rear end fences 26*a* and 27*a* and the rear end fences 5*a* and 6*a* extending from the jogger fences 5 and 6. On the lapse of a predetermined period of time after the trailing edge of the paper sheet has moved away from the paper sensor 50, the motor 11 is rotated forward and then reversed once of twice to cause the jogger fences 5 and 6 to position the paper sheet in the widthwise direction. Thereafter, the jogger fences 5 and 6 are returned to their stand-by position. Such a positioning operation repetitively occurs for each paper sheet and continues until a signal representative of the end of one job, i.e., an end-of-job signal arrives from the copier body.

On the arrival of the end-of-job signal, the above-stated operation is executed again to cause the jogger fences 5 and 6 to hold the paper sheet therebetween. In this condition, a motor 223 (FIG. 9) installed in the stapler S is driven to staple the paper stack. In the event of stapling, whether the paper stack should be stapled at a single position or at two positions is determined. If the paper sheet should be stapled at one position thereof, the jogger fences 5 and 6 are individually shifted to positions which are slightly spaced apart from the paper stack, after the paper sheet has been stapled. If the paper sheet should be stapled at two positions, the stepping motor 39 moves the stapler to another predetermined position to staple the paper stack again and, then, the stapler is returned to the original position. Then, the discharge belt 17 is rotated as indicated by an arrow M in FIG. 13 to cause its pawl 46 to push the trailing edge of the stapled paper stack upward. As a result, the paper stack is discharged onto the lower tray 53 in the same direction as the direction in which the paper sheets have been fed onto the staple tray.

Subsequently, whether or not the desired K volumes have been fully stapled and discharged is determined. If the answer is positive, the jogger fences 5 and 6 and the stapler S are moved to its home position. If otherwise, the above-stated procedure is executed again.

Regarding the up-down movement of the upper tray 107, at the time of turn-on of power supply or at the time of mode selection, a CPU (Central Processing Unit) checks the upper limit sensor SN4, lower limit sensor SN5 and paper sensor SN3 to see their output states and thereby the current position of the tray tray 107. If the upper limit sensor SN4 and paper sensor SN3 have been turned on, the elevation motor M3 is energized to lower the tray 107 until the paper sensor SN3 turns off. When only the upper limit sensor SN4 has been turned on, no operation occurs. When all the upper limit sensor SN4, lower limit sensor SN5 and paper sensor SN3 have been turned off, the elevation motor M3 is energized to elevate the tray 107 until either the upper limit sensor SN4 or the paper sensor SN3 turns on ; when the paper sensor SN3 turns on, the motor M3 is driven to lower the tray 107 until the paper sensor SN3 turns off. When only the paper sensor SN3 has been turned on, the elevation motor M3 is driven to lower the tray 107 until the paper sensor SN3 goes off. Further, when the lower limit sensor SN5 and paper sensor SN3 have been turned on, the CPU determines that the tray 107 is full and sends a tray full signal to the copier body to urge the operator to remove the paper sheets from the tray 107. On the lapse of a predetermined period of time, the elevation motor M3 is energized to raise the tray 107 until either the upper limit sensor SN4 or the paper sensor SN3 turns on. On the turn-on of the paper sensor SN3, the tray 107 is lowered until it turns off.

When the operation is restarted in the same mode, the same sequence of steps as at the time of mode selection will be executed in response to a copy start signal from the copier body after the turn-on of power supply.

During the copying operation and at the end of the same, when the paper sensor SN3 turns on, the elevation motor M3 is energized to lower the upper tray 107 until the sensor SN3 turns off. Such a procedure is repeated until the lower limit sensor SN5 turns on. Then, a tray full signal is again transmitted to the copier body. When this kind of operation overlaps with the tray shifting operation stated earlier, the former will be performed later with priority given to the latter. When the last paper sheet moves away from a copier discharge sensor 215 (FIG. 9), the copier body sends a finisher stop signal to the finisher. In response, the elevation motor M3 is energized after the last paper sheet has been fed out onto the tray 107, whereby the tray 107 is lowered by a predetermined amount to facilitate the removal of the paper sheets.

Assuming that the shifting operation is not executed at the time of the turn-on of power supply and, instead, a shift mode or a proof mode is selected. Then, in responce to a mode signal, the shift motor M2 is energized to shift the discharge tray 107 and, on the turn-on of the shift sensor 117, deenergized. This is to sort a stack of paper sheets existing on the tray 107 and a stack of paper sheets which will be stacked by the next job. Such a sorting operation will be executed only after the up-down movement of the tray 107 is completed. More specifically, when the tray 107 is shifted as stated above, the presser rollers 108 press the paper sheets and thereby prevent them from being dislocated.

During the copying operation and at the end of the same, the copier body sends a shift signal to the finisher when the last paper sheet or copy moves away from the copier discharge sensor 215. In response, the finisher energizes the shift motor M2 on the lapse of a predetermined period of time after the last paper has moved away from the sensor SN2, thereby starting on a shifting operation. As the shift sensor 117 turns on, the shift motor M2 is deenergized. This operation has priority over the up-down movement of the tray 107 and thereby eliminates the dislocation of paper sheet which would otherwise occur due to the shift.

When the operation is restarted in the same mode, the shift will not be effected at the time of the start of a copying operation and will be effected as stated above while a copying operation is under way.

Operations associated with the jogger fences 5 and 6 are as follows. As shown in FIGS. 1 and 9, on the turn-on of power supply and at the time of mode selection, the CPU checks the jogger home position sensor 14 and a tray paper sensor 205 to see their output states. If only the jogger home position sensor 14 has been turned on, nothing is performed. If the senosr 205 has been turned on, a signal representative of the presence of paper sheets on the staple tray is sent to the copier body. When the jogger home position sensor 14 and sensor 205 have been turned off, the jogger motor 11 is driven to move the jogger fences 5 and 6 toward the home position and, on the turn-on of the sensor 14, the motor 11 is deenergized.

During, at the end of and at the restart of a copying operation, a paper size signal from the copier body arrives at the finisher after the start of copying. In response, the jogger motor 11 is energized to move each of the jogger fences 5 and 6 to a position which is a predetermined amount short of the widthwise paper size and causes it to wait there. As a predetermined time expires after the paper sheet has moved away from the lower paper discharge sensor 50, the jogger motor 11 is driven to move the jogger fences 5 and 6 away from their waiting positions in order to position the paper sheet. Thereafter, the jogger fences 5 and 6 are returned to their waiting positions. More specifically, the jogger motor 11 is rotated forward and then reversed once to several times to neatly arrange the paper sheet in the widthwise direction. Such a positioning action occurs every time a paper sheet arrives at the staple tray.

When the last paper sheet or copy has moved away from the copier discharge sensor 215, a staple signal is sent from the copier body to the finisher. In response, the last paper is discharged onto the staple tray, then positioned, and then restrained by the jogger fences 5 and 6 in the widthwise direction. On completion of the stapling operation, the jogger fences 5 and 6 are shifted to positions each being slightly spaced apart from the associated widthwise edge of the paper stack. Then, the discharge belt 17 drives the stapled paper stack onto the tray 53. In this manner, the jogger fences 5 and 6 prevent the paper stack from being dislocated at the time of stapling and, in addition, serve as a guide when the stapled paper stack is driven out of the staple tray.

The above procedure is repeated until the desired number of volumes of copies have been produced. When the last stapled stack is driven out onto the tray 53, the jogger motor 11 is energized to return the jogger fences 5 and 6 to their home position. As soon as the jogger home position sensor 14 turns on, the motor 11 is deenergized.

At the time of the turn-on of power supply and when a stapler mode is selected, the CPU checks the output states of a one-rotation sensor 210, a staple sensor 211, an a stapler home sensor 212 which are shown in FIG. 9. Depending on the output states of such sensors, the CPU executes the following procedures.

When the tray paper sensor 205 has been turned on with the one-rotation sensor 210 having been turned off, a stapler error signal is transmitted to the copier body.

If the staple sensor 211 has been turned off, a no staple signal is sent to the copier body. When the stapler home sensor 40 (FIG. 12) has been turned on, nothing is performed. If the stapler home sensor 40 has been turned off and the one-rotation sensor 210 has been turned on, the stepping motor 39 is energized to shift the stapler S to the home position; on the turn-on of the stapler home sensor 40, the motor 39 is deenergized. When the one-rotation sensor 210 has been turned off, the program waits by determining that a stapling action has failed or that jam processing has been performed previously. When the one-rotation sensor 210 is turned on by idle stapling or similar artificial processing, the motor 29 is energized to move the stapler S toward the home position. As soon as the stapler home sensor 40 turns on, the motor 39 is deenergized.

During, at the end of and at the restart of copying, when a paper size signal is received after the copier has started on a copying operation, the motor 39 is energized to move the stapler S by a predetermined amount to a particular position matching the paper size. After the last one of the set of paper sheets has moved away from the copier discharge sensor 215, a staple ON signal is sent from the copier to the finisher. In response, the last paper sheet is fed onto the staple tray and, as soon as the jogger fences 5 and 6 retain the paper stack at opposite widthwise edges of the latter, the staple motor 223 is energized to cause a stapling action to occur. The staple drive motor 223 is deenergized when the one-rotation sensor turns on. In a two-position staple mode, the stapler shift motor 39 is energized to move the stapler S over a predetermined distance, and then it is deenergized to cause a stapling action to occur at the second position. Such a stapling operation is repeated until a desired number of volumes have been produced. When the last paper stack is stapled, the motor 39 is energized to return the stapler S toward the home position and, on the turn-on of the stapler home sensor 40, it is deenergized.

The discharge belt 17 is operated as follows.

On the turn-on of power supply and at the time of mode selection, the CPU checks the belt home sensor 48, tray paper sensor 205 and one-rotation sensor 210 to see their output states. If the belt home sensor 48 has been turned on and the tray paper sensor 205 has been turned off, no further processing occurs. If both the belt home sensor 48 and the tray paper sensor 205 have been turned off, the CPU determines that the discharge belt 17 has not been returned to the home position, energizes the belt motor 22 to move the belt 17, and deenergizes the belt motor 22 when the belt home sensor 48 turns on. If the belt home sensor 48 has been turned off and the tray paper sensor 205 has been turned on, the CPU determines that paper discharge has failed and sends a signal to the copier body for urging the operator to remove the paper sheets from the staple tray. After the removal of the paper stack, the motor 22 is energized to move the belt 17 and, on the turn-on of the belt home sensor 48, it is deenergized.

During and at the end of copying, when the stapler S staples a paper stack which includes the last paper sheet or copy, the one-rotation sensor 210 turns on to indicate that the stapler S has stapled the paper stack without fail. Thereafter, the belt motor 22 is energized to cause the belt 17 to move the stapled paper stack onto the discharge tray 53. The motor 22 is deenergized when the belt home sensor 48 turns on. This kind of operation is repeated with each of a desired number of paper stacks.

Regarding the transport line associated with the upper tray 107, the transport motor 220 (FIG. 9) is energized in response to a finisher start signal which is fed from the copier body on the start of a copying operation. Specifically, the motor 220 is driven at a lower speed which is the same as the linear speed of the copier body. When a paper sheet driven out of the copier turns on the inlet sensor SN1, a timer is started to see if the paper sheet moves away from the inlet sensor SN1 within a predetermined period of time, i.e., if a jam occurs. When the trailing edge of the paper sheet moves away from the inlet sensor SN1, the sensor SN1 turns off so that the the motor 220 is switched to a higher speed to increase the paper transport rate. Further, a timer is started to see if the outlet sensor SN2 turns on within a predetermined period of time in response to the leading edge of the paper sheet, i.e., if a jam occurs. On the lapse of a predetermined period of time after the paper sheet has moved away from the inlet sensor SN1, the motor 220 is switched back to the lower speed to prepare for the entry of the next paper sheet. As the outlet sensor SN2 turns on by sensing the leading edge of the paper sheet, a timer is set to see if the paper sheet moves way from the sensor SN2 within a predetermined period of time.

The procedure described above is repeated thereafter. In the upper tray mode, after the arrival of a shift signal, a shift OK signal appears on the lapse of a predetermined period of time after the last one of a set of paper sheet has moved away from the outlet sensor SN2. Then, a timing for executing a shift is measured. When the last paper sheet is driven out of the copier body, a finisher stop signal arrives at the finisher. In response, the motor 220 is deenergized when a predetermined period of time expires from the time when the last paper sheet has moved away from the outlet sensor SN2.

Regarding the transport line associated with the staple tray, the transport motor 220 is energized by the previously mentioned finisher start signal and rotated at the same speed as the linear speed of the copier body. When the inlet sensor SN1 turns on by sensing the leading edge of a paper sheet, the solenoid 230 and a lower transport motor 226 (FIG. 9) are energized. At the same time, a timer is set to see if the paper sheet moves away from the inlet sensor SN1 within a predetermined period of time, i.e., if a jam occurs. When the trailing edge of the paper sheet moves away from the inlet sensor SN1, the sensor SN1 turns off and, on the lapse of a predetermined period of time, the motor 226 is switched to a higher speed to increase the paper transport rate. A timer is set to see if a lower outlet sensor 50 turns on within a predetermined period of time by sensing the leading edge of the paper sheet, i.e., if a jam occurs. As a predetermined period of time expires after the trailing edge of the paper sheet has moved away from the inlet sensor SN1, the solenoid 230 is deenergied. When the outlet sensor 50 turns on in response to the paper sheet, a timer is set to see if the paper sheet moves away from the sensor 50 within a predetermined period of time. When a predetermined period of time expires after the paper sheet has moved away from the outlet sensor 50, the motor 226 is switched over to the lower speed.

After the above procedure has been repeated, a staple signal arrives at the finisher. In response, on the lapse of a predetermined period of time after the last paper sheet of a set of copies has moved away from the lower outlet sensor 50, the jogger fences position the paper sheets. Thereafter, a timing for a shift is measured. The copier body sends a finisher stop signal to the finisher when it discharges the last paper sheet, as stated earlier. In response, the motors 220 and 226 are deenergized on the lapse of a predetermined period of time after the last paper sheet has moved away from the outlet sensor 50.

Figures 16, 16A:
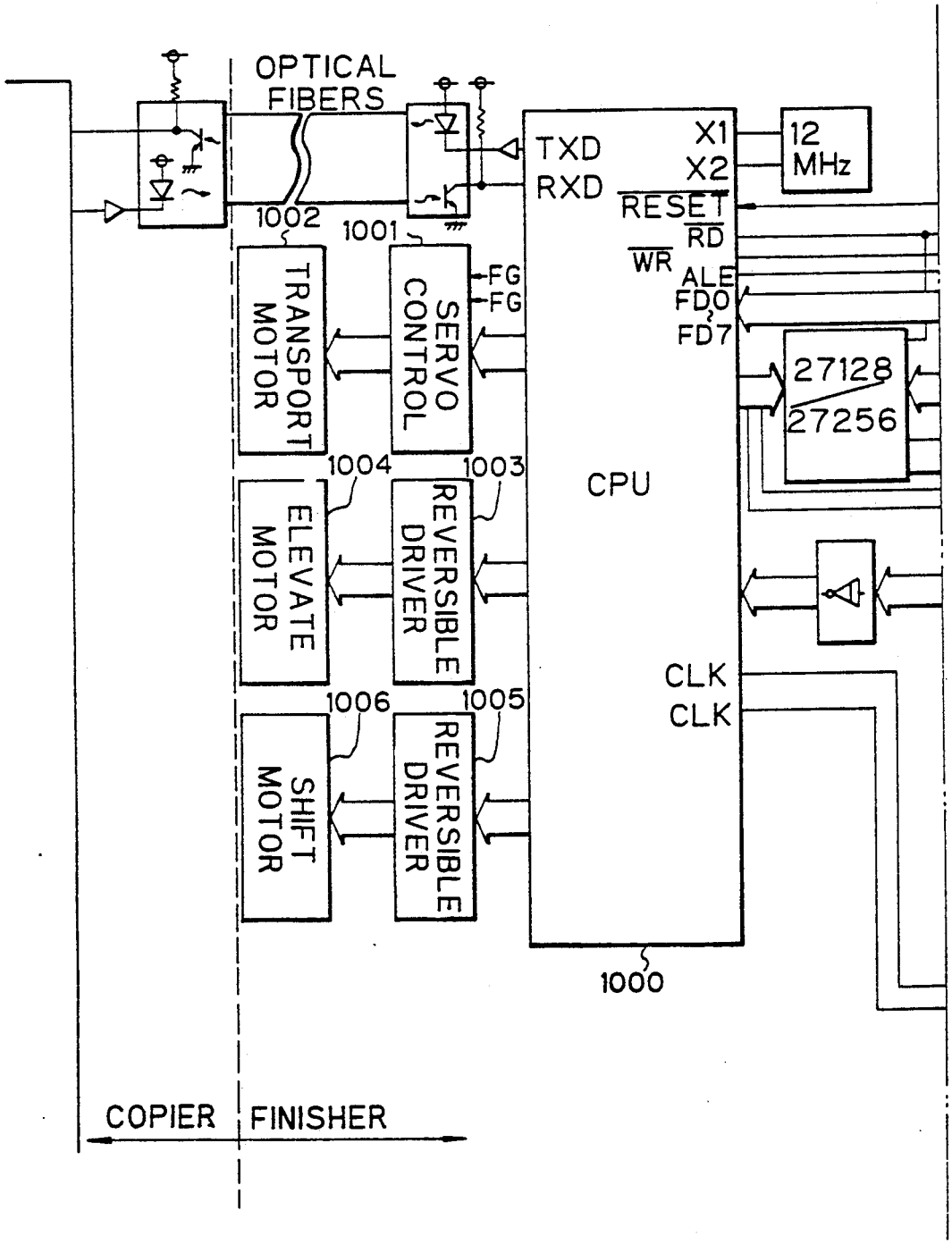
FIGS. 16, 16A and 16B are schematic block diagrams showing a specific construction of control circuitry for practicing the present invention.
Figure 16B:
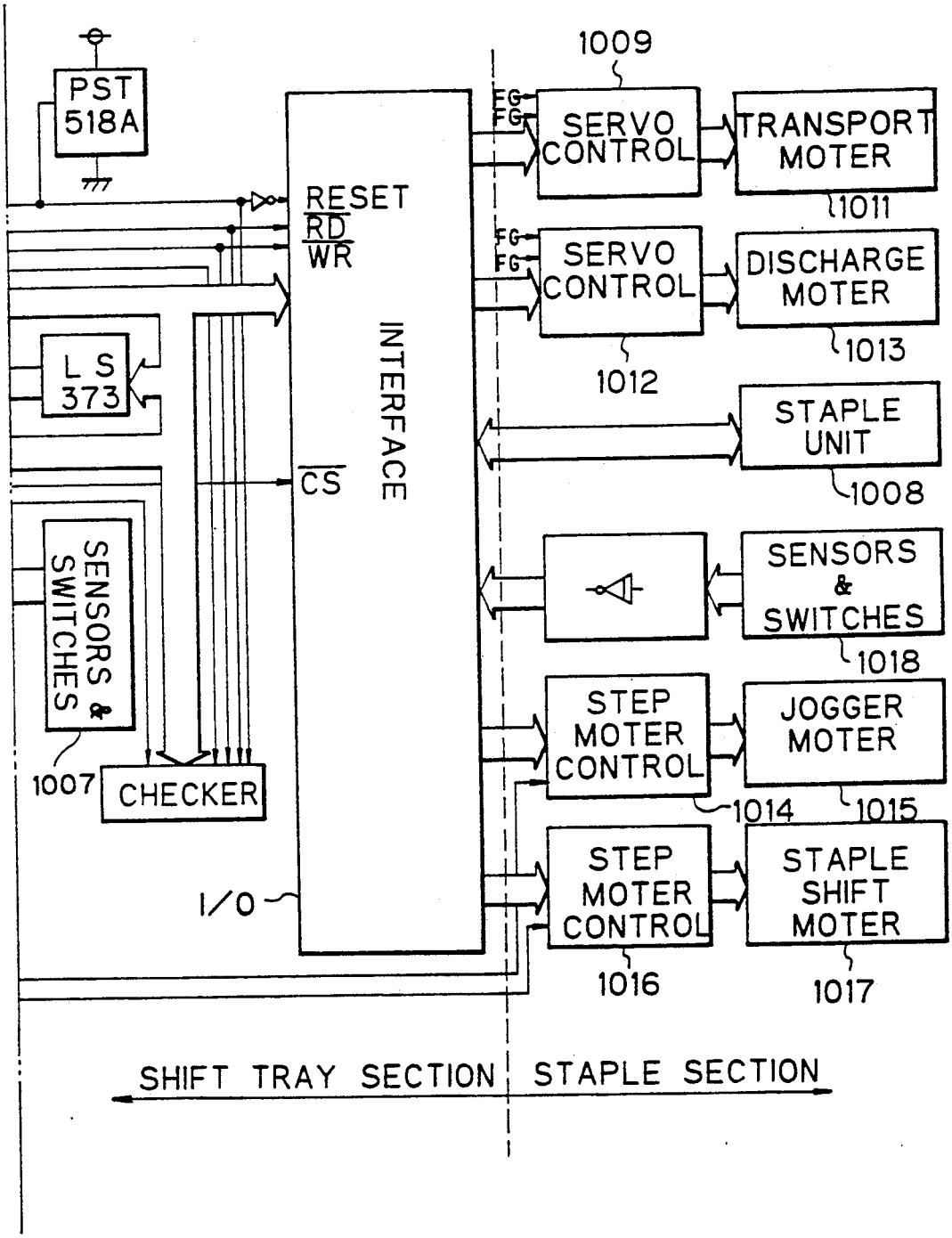

As shown in FIG. 16, a CPU 1000 installed in the finisher is interconnected to a CPU of the copier by an optical fiber. As shown, a shift tray section includes a transport motor 1002, an elevation motor 1004, and a shift motor 1006. The motors 1002, 1004 and 1006 are interconnected to the CPU 1000 via a servo control circuit 1001, a reversible driver 1003, and a reversible driver 1005, respectively. Also interconnected to the CPU 1000 are various sensors and switches 1007.

A staple section is interconnected to the CPU 1000 via an interface I/O by a connector. In the staple section, a staple unit 1008 is interconnected to the interface I/O. A transport motor 1011, a discharge motor 1013, a jogger motor 1015, and a stapler shift motor 1017 are interconnected to the interface I/O via a servo control circuit 1009, a servo control circuit 1012, a stepping control type motor control circuit 1014, and a stepping control type motor control circuit 1016, respectively. Further interconnected to the interface I/O are various sensors and switches 1018.

In summary, it will be seen that the present invention provides a finisher which accurately positions paper sheets by a paper positioning member or fur brush having a simple configuration, frees paper sheets from excessive forces and, therefore, from creases and bends, prevents the paper positioning member from interfering with the shifting motion of a tray and thereby insures sure positioning of paper sheets. The finisher is, therefore, capable of sorting paper sheets volume by volume in a desirable manner.

Various modifications will become possible for those skilled in the art after receiving the teachings of the present disclosure without departing from the scope thereof.

What is claimed is:

1. A finisher for finishing recording sheets sequentially driven out of an image forming apparatus, comprising:

a tray for collecting paper sheets sequentially driven out of said image forming apparatus; and sorting means for causing said tray to move in a horizontal plane in a direction perpendicular to an intended direction of paper discharge and thereby sorting the paper sheets;

said sorting means comprising:

a positioning member for urging the paper sheet discharged onto said tray to a predetermined position;

a stop member adjoining said predetermined position;

said positioning member comprising fur brushes each being rotatable in contact with the upper surface of the paper sheet and in contact with said stop member; and wherein a frictional force exerted by said fur brushes in rotation in a direction for thrusting the paper sheets is smaller than a directional force acting between said fur brushes and said stop member.

2. A finisher as claimed in claim 1, wherein said fur brushes exert a smaller resistance on uppermost one of the paper sheets stacked on said tray when in rotation than when out of rotation.

3. A finisher as claimed in claim 1, wherein said tray is shifted with the trailing edge of the uppermost paper sheet on said tray being held in abutment against said stop member by said fur brushes which are in rotation.

4. A finisher for finishing recording sheets sequentially driven out of an image forming apparatus, comprising:

a tray for collecting paper sheets sequentially driven out of said image forming apparatus; and sorting means for causing said tray to move in a horizontal plane in a direction perpendicular to an intended direction of paper discharge and thereby sorting the paper sheets;

said sorting means comprising a positioning member for urging the paper sheet discharged onto said tray to a predetermined position and a stop member adjoining said predetermined position, said positioning member being rotatable in contact with the upper surface of the paper sheet and in contact with said stop member;

wherein a frictional force exerted by said positioning member in rotation in a direction for thrusting the paper sheets is smaller than a frictional force acting between said positioning member and said stop member.

5. A finisher as claimed in claim 4, wherein said positioning member comprises fur brushes which are rotatable in contact with the upper surface of the paper sheet and in contact with said stop member.

6. A finisher for finishing recording sheets sequentially driven out of an image forming apparatus, comprising:

a tray for collecting paper sheets sequentially driven out of said image forming apparatus; and sorting means for causing said tray to move in a horizontal plane in a direction perpendicular to an intended direction of paper discharge and thereby sorting the paper sheets;

said sorting means comprising a positioning member for urging the paper sheet discharged onto said tray to a predetermined position and a stop member adjoining said predetermined position, said positioning member being rotatable in contact with the upper surface of the paper sheet and in contact with said stop member;

wherein when the paper sheets are sorted by said sorting means, said tray is caused into a shifting motion in the horizontal plane while said positioning member is rotated.

7. A finisher as claimed in claim 6, wherein a frictional force acting between the trailing edge of the paper sheets and said stop member is greater than a frictional force exerted by said positioning member in rotation in a direction for thrusting the paper sheets.

8. A finisher as claimed in claim 6, wherein a frictional force exerted by said positioning member in rotation in a direction for thrusting the paper sheets is smaller than a frictional force acting between said positioning member and said stop member.

* * * * *